US005947189A

United States Patent [19]

Takeuchi et al.

[11] Patent Number: 5,947,189

[45] Date of Patent: Sep. 7, 1999

[54] HEAT EXCHANGING SYSTEM HAVING COOLING FAN, FOR VEHICLE

[75] Inventors: Kazuhiro Takeuchi, Okazaki; Toshiki Sugiyama; Takuya Usami, both of Kariya, all of Japan

[73] Assignee: Denso Corporation, Kariya, Japan

[21] Appl. No.: 09/037,380

[22] Filed: Mar. 10, 1998

[30] Foreign Application Priority Data

Mar. 11, 1997 [JP] Japan ..... 9-056489

[51] Int. Cl.[6] ..... F01P 1/06; H05K 7/20

[52] U.S. Cl. ..... 165/51; 165/44; 165/80.3; 165/121; 123/41.31; 236/35; 361/690; 361/697

[58] Field of Search ..... 165/80.3, 121, 165/122, 44, 51; 123/41.11, 41.31; 236/35; 361/690, 697

[56] References Cited

U.S. PATENT DOCUMENTS 5,481,433 1/1996 Carter ..... 361/690

5,671,802 9/1997 Rogers ..... 154/80.3 X 5,715,140 2/1998 Sikunas et al. ..... 361/690

FOREIGN PATENT DOCUMENTS 251418 11/1987 Japan .

*Primary Examiner*—Leonard Leo

*Attorney, Agent, or Firm*—Harness, Dickey & Pierce, PLC

[57] ABSTRACT

A heat exchanging system includes two cooling fans for cooling heat exchanging medium of a heat exchanger, and a control device for controlling rotational speeds of the cooling fans. The control device is attached to an outer surface of a fan shroud so that radiation fins of the control device is disposed inside the fan shroud. Further, the radiation fins of the control device is disposed between two fan accommodating portions each having a cylindrical shape. That is, the control device is disposed in a comparatively large space formed by two fan accommodating portions. Therefore, the control device can be readily attached to the fan shroud on a vehicle, and the size of the radiation fins can be made larger. Thus, the heat exchanging system cools the control device sufficiently while improving ventilation performance of the cooling fans.

20 Claims, 5 Drawing Sheets

HEAT EXCHANGING SYSTEM HAVING COOLING FAN, FOR VEHICLE

CROSS REFERENCE TO RELATED APPLICATION

This application relates to and incorporates herein by reference Japanese Patent Application No. Hei. 9-56489 filed on Mar. 11, 1997.

BACKGROUND OF THE INVENTION

1. Field of the Invention

The present invention relates to a heat exchanging system for a vehicle, which adjusts a cooling performance of a cooling fan by controlling a rotational speed of an electric motor using a semiconductor switching element.

2. Related Art

JP-A-62-251418 proposes an automotive heat exchanging system for adjusting a cooling performance of a cooling fan by using a semiconductor switching element. This conventional system includes a suction-type cooling fan disposed on the vehicle rear side of a radiator which cools an engine cooling water. Air generated by the cooling fan flows from the vehicle front side to the vehicle rear side.

A fan shroud is disposed between the radiator and the cooling fan for guiding cool air to readily pass through the radiator. An electric motor for driving the cooling fan is disposed in a downstream air part of the fan shroud using a plurality of stays. A rotational speed of the electric motor is controlled according to a pulse width modulated control (i.e., PWM control) performed by a control device having a semiconductor switching element. Thus, the rotational speed of the cooling fan is controlled by the control device to control a ventilation performance of the cooling fan.

Further, the control device has a plurality of radiation fins for facilitate heat radiation of the semiconductor switching element. The control device having the radiation fins is attached to a downstream-air-side surface of a stay which is formed wider than the other stays, so that the attachment of the control device to the fan shroud is reinforced.

However, because the control device is attached to the wider stay, a ventilation resistance becomes larger in the wider stay, resulting in deterioration of the ventilation performance of the cooling fan. Even if the stay to which the control device is attached is narrower, the control device protrudes outwardly from the stay and interrupts air flow. Thus, there is a problem that the ventilation performance of the cooling fan is deteriorated.

SUMMARY OF THE INVENTION

It is an object of the present invention to provide a heat exchanging system for a vehicle, which cools a control device sufficiently and improves a ventilation performance of a cooling fan.

According to the present invention, an air guiding duct is disposed between a heat exchanger and a cooling fan, and a control device is attached to an outer surface of the air guiding duct in such a manner that a radiation fin unit of the control divice is disposed inside the air guiding duct. Therefore, it can prevent a ventilation performance of the cooling fan from being reduced by providing the control device. Further, because the radiation fin unit is disposed inside the air guiding duct, cool air generated by the cooling fan is also blown toward the radiation fin unit to sufficiently cool the control device having a semiconductor switching element.

Preferably, the air guiding duct has an air intake port at an upstream air side proximate to the radiation fin unit. Therefore, cool air flows into the air guiding duct from outside through the air intake port without passing through the heat exchanger. Thus, the radiation fin unit is sufficiently cooled by cool air to improve the heat radiation performance of the radiation fin unit. As a result, a heat exchanging system of the present invention cools the control device sufficiently while improving the ventilation performance of the cooling fan. Further, the radiation fin unit has a plurality of plate-like radiation fins laminated at an interval in parallel with a flow direction of air flowing through the air guiding duct. Therefore, cool air passes through the whole radiation fins without interrupting the flow of cool air. Thus, the heat exchanging system improves heat-radiating capacity of the radiation fin unit to sufficiently cool the control device.

More preferably, the cooling fan has a first fan portion and a second fan portion, and the radiation fan unit of the control device is disposed at a center portion between the first and second fan portions. Therefore, even when either one of the two fan portions stops operation, the control device can be cooled by the other fan portion.

BRIEF DESCRIPTION OF THE DRAWINGS

Additional objects and advantages of the present invention will be more readily apparent from the following detailed description of a preferred embodiment with reference to the accompanying drawings, in which.

DETAILED DESCRIPTION OF THE PREFERRED EMBODIMENT

Figure 1:
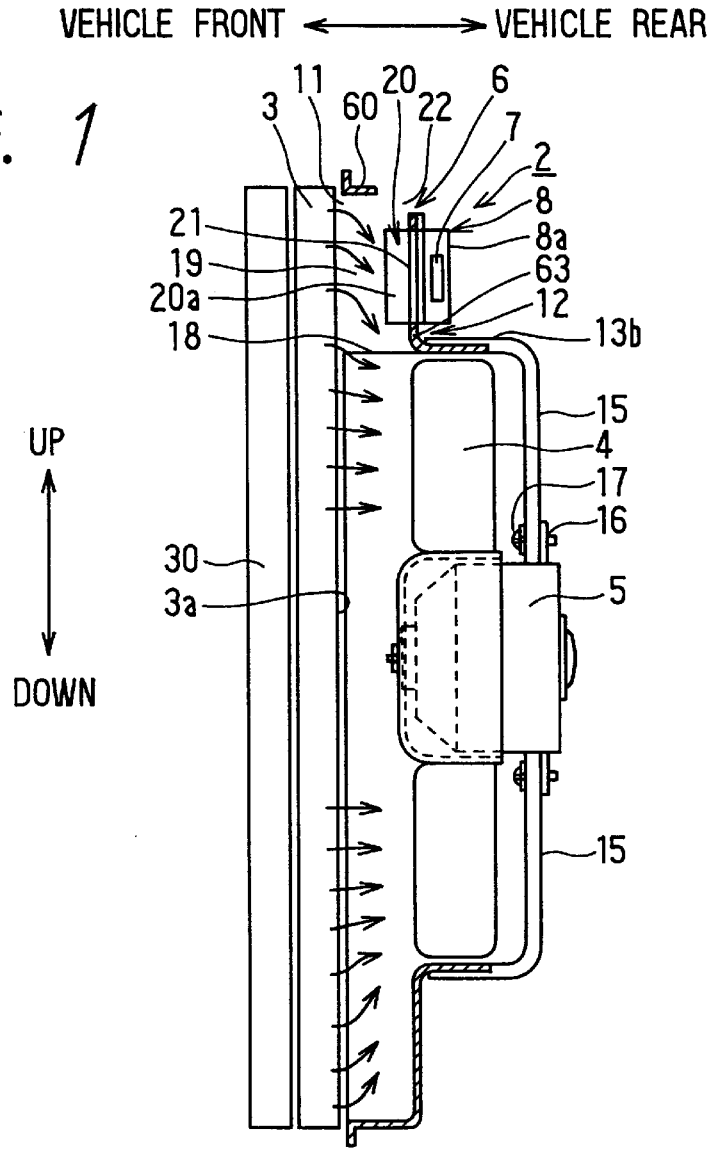
FIG. 1 is a schematic cross-sectional view showing a heat exchanging system according to a preferred embodiment of the present invention.

A preferred embodiment of the present invention will be described. In the embodiment, a heat exchanging system cools cooling water of an engine 1 for a vehicle, and cools and condenses refrigerant of a refrigerant cycle for an air conditioning device. The heat exchanging system 2 is disposed in an engine compartment of the vehicle so that cool air flows substantially perpendicularly to the vehicle width direction. The engine 1 is disposed in the engine compartment to be opposite to the heat exchanging system. The other various equipments (not shown) are also accommodated in the engine compartment.

The heat exchanging system 2 includes a radiator 3, a condenser 30, two cooling fans 4, two electric motors 5, a fan shroud 6, a control device 8 and the like.

The radiator 3 is a heat exchanger. The cooling water of engine 1 flows inside the radiator 3, and is used as a heat exchanging medium. The radiator 3 is formed, in a rectangular shape having a thin thickness, by alternately laminating a plurality of flat tubes made of aluminum and a plurality of fins for improving a heat exchanging effective, as being known well. The condenser 30 is also a heat exchanger. Refrigerant flows inside the condenser 30, and is used as a heat exchanging medium. The condenser 30 is formed, in a rectangular shape having a thin thickness, by alternately laminating a plurality of flat tubes made of aluminum and a plurality of fins for improving a heat exchanging effective, as being known well. The condenser 30 is disposed at a vehicle front side of the radiator 3 to be opposite to the radiator 3. The radiator 3 and condenser 30 are disposed at a vehicle front side of the engine 1 in the engine compartment to be opposite to the engine 1. The cooling fans 4 are disposed between the engine 1 and the radiator 3. Each of the cooling fans 4 is an axial-flow fan and generates cool air toward the radiator 3 and the condenser 30 to cool the cooling water in the radiator 3 and the refrigerant in the condenser 30. The cooling fans 4 are suction-type cooling fans and disposed at a downstream air side of the condenser 30 and the radiator 3 as shown in FIG. 1.

Figure 2:
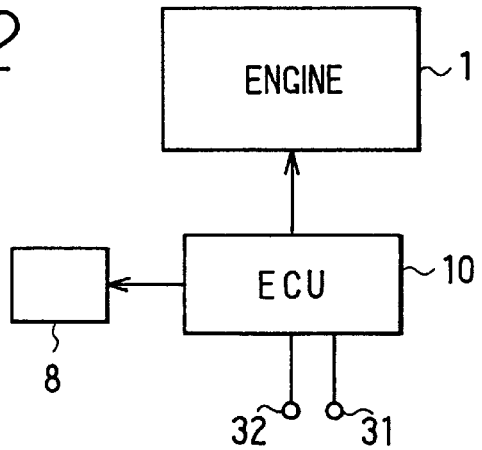
FIG. 2 is a block diagram of an electric control of the heat exchanging system according to the embodiment.

The two electric motors 5 respectively drive the cooling fans 4 when electric power is supplied to the electric motors 5 from a battery mounted on the vehicle. Each rotational speed of the electric motors 5 is controlled by the control device 8 having a semiconductor switching element 7. As shown in FIG. 2, the control device 8 is connected to an ECU 10 which is a well-known computing unit provided with ROM, RAM and the like. Each of the rotational speed of the electric motors 5 is controlled according to signals from the ECU 10. The control device 8 and ECU 10 will be specifically described later.

Figure 3:
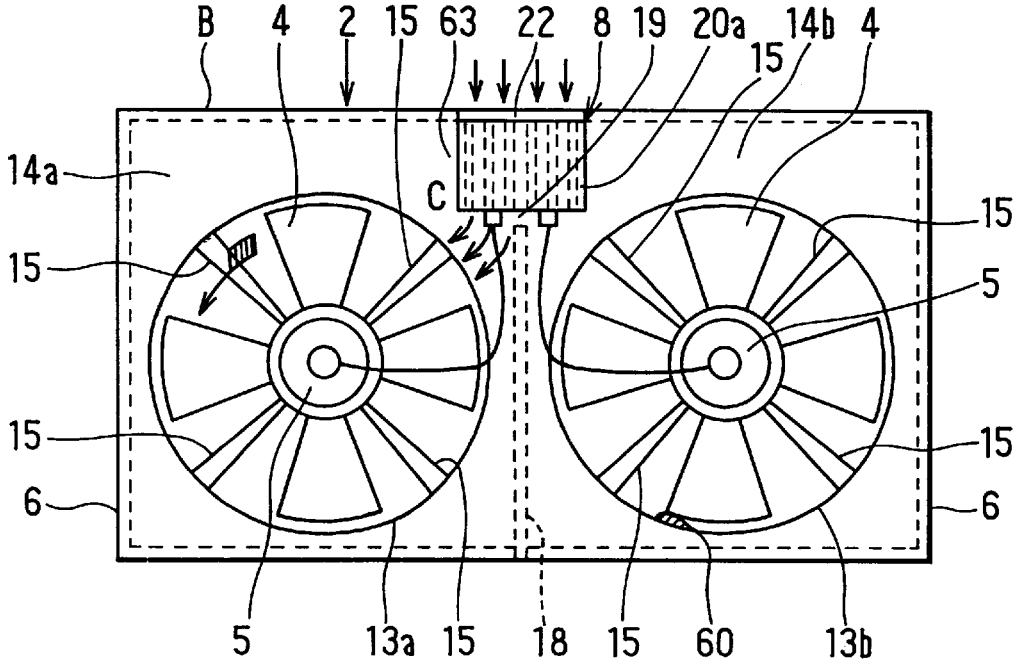
FIG. 3 is a front view of the heat exchanging system when viewed from a vehicle rear side toward a vehicle front side according to the embodiment.

The fan shroud 6 is disposed between the radiator 3 and the cooling fans 4 as shown in FIG. 1. The fan shroud 6 is made of resin such as polypropylene and formed into a duct. The fan shroud 6 guides cool air generated by the cooling fans 4 to passes through the radiator 3. The fan shroud 6 has a step portion 12 so that air flowing area is reduced as air flows from an upstream air side to a downstream air side of the cooling fan 4. Further, the fan shroud 6 has a duct portion 60 at an upstream air side of the cooling fan 4, and the duct portion 60 is approximately formed along the outer shape of the radiator 30. Furthermore, the fan shroud 6 has fan storage portions 13*a* and 13*b* for respectively accommodating the cooling fans 4, and each of the fan storage portions 13*a* and 13*b* are formed in a cylindrical shape to extend toward the vehicle rear side. As shown in FIG. 3, the two fan storage portions 13*a* and 13*b* are arranged in parallel in the vehicle width direction.

The fan shroud 6 further has an attachment portion 63 which connects a downstream-air-side end of the duct portion 60 and an upstream-air-side ends of the fan storage porions 13*a* and 13*b*. The attachment portion 63 extends in substantially up-down direction in FIG. 1 to be substantially parallel to a ventilation surface 3*a* of the radiator 3.

Four stays 15 for supporting each of the electric motors 5 are formed integrally with the fan shroud 6 at a downstream air side of the fan storage portions 13*a* and 13*b* for respectively holding the electric motors 5. Each of the stays 15 has a thickness slightly thicker than the fan shroud 6 so that the attachment of the electric motors 5 to the stays 15 is reinforced. The electric motors 5 are attached to the stays 15 with brackets 16 and screws 17 as shown in FIG. 1. The brackets 16 are fixed to the outer surface of the stays 15 of the electric motors 5.

As shown in FIGS. 1 and 3, within the fan shroud 6, a partition member 18 is integrally formed between the two cooling fans 4 to partition an interior of the fan shroud 6 into two air passages 14*a* and 14*b* corresponding to the cooling fan 4. The partition member 18 extends in a substantially vertical direction in FIG. 3 to prevent cool air generated by each cooling fan 4 from interfering with each other. Therefore, when each volume of cool air generated by the two cooling fans 4 increases, each ventilation performance of the two cooling fans 4 is improved. As shown in FIG. 3, an upper end of the partition member 18 is not connected to the fan shroud 6 to form a communication path 19 between the two air passages 14*a* and 14*b*.

The control device 8 has a cover 8*a* made of resin, and the semiconductor switching element 7 (i.e., MOS transistor) for controlling each rotational speed of the electric motors 5. The semiconductor switching element 7 is disposed within the cover 8*a*. The cover 8*a* also accommodates a driving circuit, a signal processing portion, a control portion and the like (not shown). Signals sent from the ECU 10 are input to the control portion of the control device 8.

Figure 4:
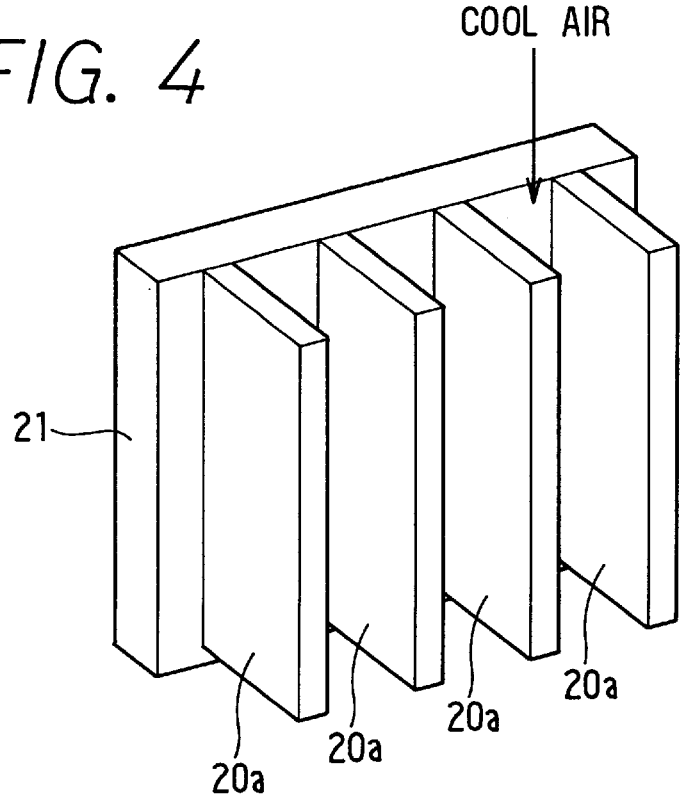
FIG. 4 is a perspective view showing a plurality of radiation fins of a control device of the heat exchanging system according to the embodiment.

The control device 8 is provided with a radiation fin unit 20 for promoting radiation of heat generated by the semiconductor switching element 7. The radiation fin unit 20 includes a plurality of radiation fins 20*a* made of metal having a sufficient heat-transmission performance such as aluminum, and a substrate 21. As shown in FIG. 4, the radiation fins 20*a* are disposed on the substrate 21 so that the radiation fins 20*a* are laminated at an interval. Further, the radiation fins 20*a* are disposed to be parallel to an air flow direction indicated by the arrows in FIGS. 1 and 3. The duct portion 60 of the fan shroud 6 has an air intake portion 22 at an immediately upstream air side of the radiation fin unit 20.

Figure 5:
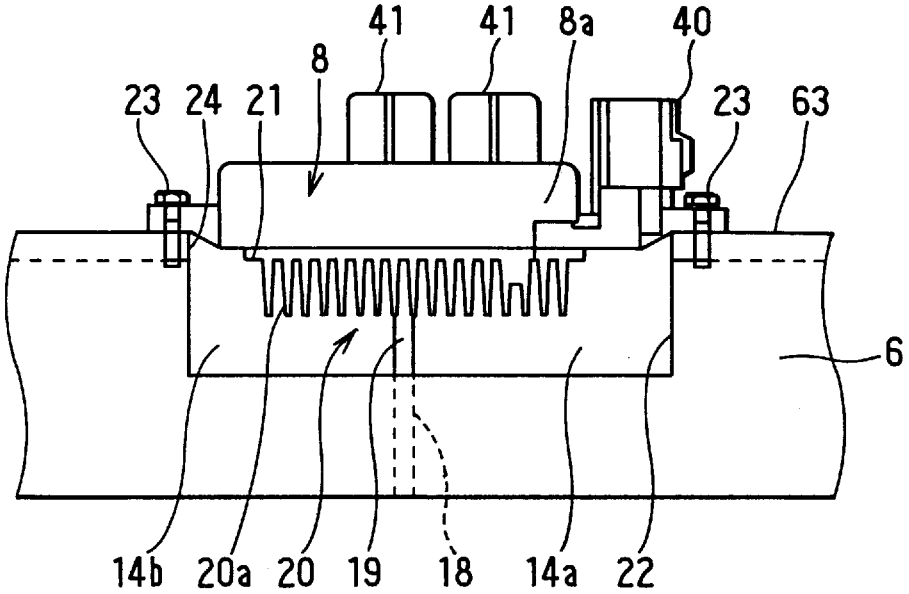
FIG. 5 is a schematic cross-sectional view showing the control device attached in a fan shroud of the heat exchanging system according to the embodiment.

As shown in FIG. 5, the radiation fin unit 20 is attached to the cover 8*a* of the control device. Two connectors 41 are used for electrical connection between the control device 8 and the two electric motors 5.

Next, the attachment structure of the control device 8 will be described with reference to FIGS. 1, 3 and 5. FIG. 5 is a top view showing the control device 8 attached to the fan shroud 6 when viewed from an upper side to a lower side in FIG. 3. The control device 8 is attached to an outer surface of the attachment portion 63 so that the radiation fin unit 20 is placed inside the fan shroud 6. Specifically, the control device 8 is located at a upper center portion between the fan storage portions 13*a* and 13*b* to be proximate to an outline B of the duct portion 60 as shown in FIG. 3. That is, the attachment portion 63 is set to an area C shown in FIG. 3. Therefore, the control device 8 is disposed at the area C having a comparatively large space. Because the area C is made large, the dimension of the radiation fin unit 20 can be increased to improve heat radiation of the control device 8.

To attach the control device 8 at the area of C in FIG. 3, the fan shroud 6 has an opening portion 24 through which inside air and outside air of the fan shroud 6 are communicated. The opening portion 24 is provided between the two cooling fans 4 to correspond to the communicating path 19. The opening portion 24 extends over both the air passages 14*a* and 14*b* as shown in FIG. 3.

As shown in FIG. 5, the control device 8 is attached to the outer surface of the attachment portion 63 using screws 23 so that the radiation fin unit 20 is disposed inside the fan shroud 6 through the opening portion 24. Therefore, the flow of air is not affected by providing the control device 8 to improve the ventilation performance of the cooling fans 4.

Further, because the radiation fin unit 20 is exposed to cool air (indicated by the arrows in FIG. 1) sufficiently, the radiation fin unit 20 can sufficiently radiate heat generated by the semiconductor switching element 7 to sufficiently cool the control device 8.

Further, because the attachment portion 63 is disposed to extend in parallel with the ventilation surface 3*a* of the radiator 3, a space for accommodating the control device 8 is made relatively large to prevent the control device 8 from interfering other parts of the vehicle. As a result, the total dimension of the radiator 3, the fan shroud 6 and the cooling fans 4 in the arrangement direction (i.e., front-rear direction of the vehicle) thereof is reduced to readily dispose the control device 8 in the vehicle.

Furthermore, because the radiation fin unit 20 is disposed in the communication path 19 to cross the both air passages 14*a* and 14*b*, cool air generated by the both cooling fans 4 is used for cooling the radiation fin unit 20. Therefore, even when one cooling fan 4 stops operation due to some problems such as entanglement of a foreign matter, the control device 8 can be cooled by the other cooling fan 4.

Further, because of the pressure difference between inside and outside air of the fan shroud 6 during operation of the cooling fans 4, cool air which flows outside the fan shroud 6 without passing through the radiator 3 is introduced into the fan shroud 6 from the air intake 22 to be blown toward the radiation fin unit 20. Therefore, the radiation fin unit 20 is sufficiently cooled by cool air to improve the heat radiation performance of the radiation fin unit 20. Thus, in the embodiment, the control device 8 is sufficiently cooled.

Furthermore, because the radiation fins 20*a* are disposed to be parallel to the air flow direction in the fan shroud 6, cool air is blown to the whole radiation fins 20*a* to sufficiently cool the radiation fin unit 20 without interrupting the flow of cool air. This also improves the radiation performance of the radiation fin unit 20.

The ECU 10 is a well-known computing unit including ROM, RAM and the like for controlling the engine 1. As shown in FIG. 2, the ECU 10 is connected to input terminals such as a temperature sensor 31 and a pressure sensor 32. The temperature sensor 31 detects the temperature of the cooling water of the engine 1, and the pressure sensor 32 detects the pressure of the refrigerant in the condenser 30 (i.e., discharging pressure of the refrigerant from a compressor of the refrigerant cycle).

The control device 8 is electrically connected to the ECU 10 by a connection portion 40 shown in FIG. 5. The control device 8 receives signals from the temperature sensor 31 and the pressure sensor 32 via the ECU 10 and controls the electric motors 5 according to a pulse width modulated control (i.e., PWM control). That is, the control device 8 controls each rotational speed of the electric motors 5 according to the conditions of the heat exchanging mediums flowing inside the radiator 3 and the condenser 30.

Figure 6:
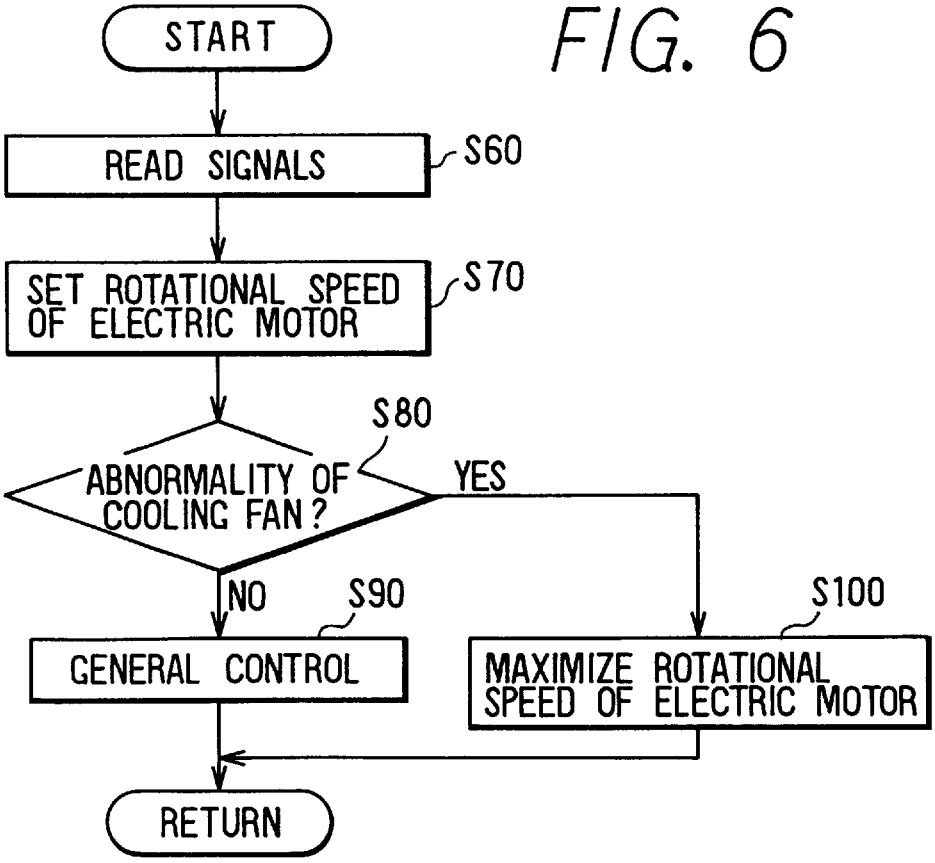
FIG. 6 is a flow chart showing a control process of the heat exchanging system according to the embodiment.

Next, the control process of the control device 8 will be now described with reference to FIG. 6.

First, at step S60, the control device 8 reads and records the signals sent from the temperature sensor 31 and the pressure sensor 32. Next, each rotational speeds of the two electric motors 5 is set at step S70. That is, a first rotational speed is determined according to the water temperature detected by the temperature sensor 31 and then a second rotational speed is determined according to the refrigerant pressure detected by the pressure sensor 32. The faster speed of either the first and second rotational speeds is determined as target rotational speeds of each electric motors 5 (hereinafter, the determination method is referred to as "general control"). When the refrigerant cycle does not operate, the target rotational speeds of each electric motor 5 are determined only by the water temperature detected by the temperature sensor 32. Next, at step S80, the control device 8 determines whether nor not the cooling fans 4 have an abnormity. For example, the abnormity of the cooling fans 4 is that foreign matters are entangled in one of the cooling fans 4 to stop the operation of the cooling fan 4. In this case, because a current value of the cooling fan 4 becomes larger, the control device 8 can detect the abnormity of the cooling fan 4 by measuring the current value. When both the two cooling fans 4 operate normally, the general control is performed in the control device 8 at step S90. When either one of the cooling fans 4 has the abnormity, the control device 8 proceeds to step S100 and increases the rotational speed of the electric motor 5 connected to the other cooling fan 4. In this embodiment, the rotational speed of the electric motor 5 is increased to maximize the rotational speed of the electric motor 5. Thus, even when either one of the cooling fans 4 is stopped, the other cooling fan 4 can generate cool air in the maximum operation to sufficiently cool the engine cooling water in the radiator 3 and the refrigerant in the condenser 30.

Although the present invention has been fully described in connection with preferred embodiment thereof with reference to the accompanying drawings, it is to be noted that various changes and modifications will become apparent to those skilled in the art.

For example, in the above-described embodiment, the heat exchanging system 2 has both the radiator 3 and the condenser 30; however, the heat exchanging system 2 may have either one of them. In the above-described embodiment, the radiation fins 20*a* are disposed to be parallel to the air flow direction in the fan shroud 6; however, the radiation fins 20*a* may be disposed perpendicular to the air flow direction. Further, pin-like radiation fins may be used instead of the plate-like radiation fins 20*a*. The radiation fins 20*a* may have notches such as louvers to improve heat-radiating performance of the radiation fins 20*a*.

Figure 7:
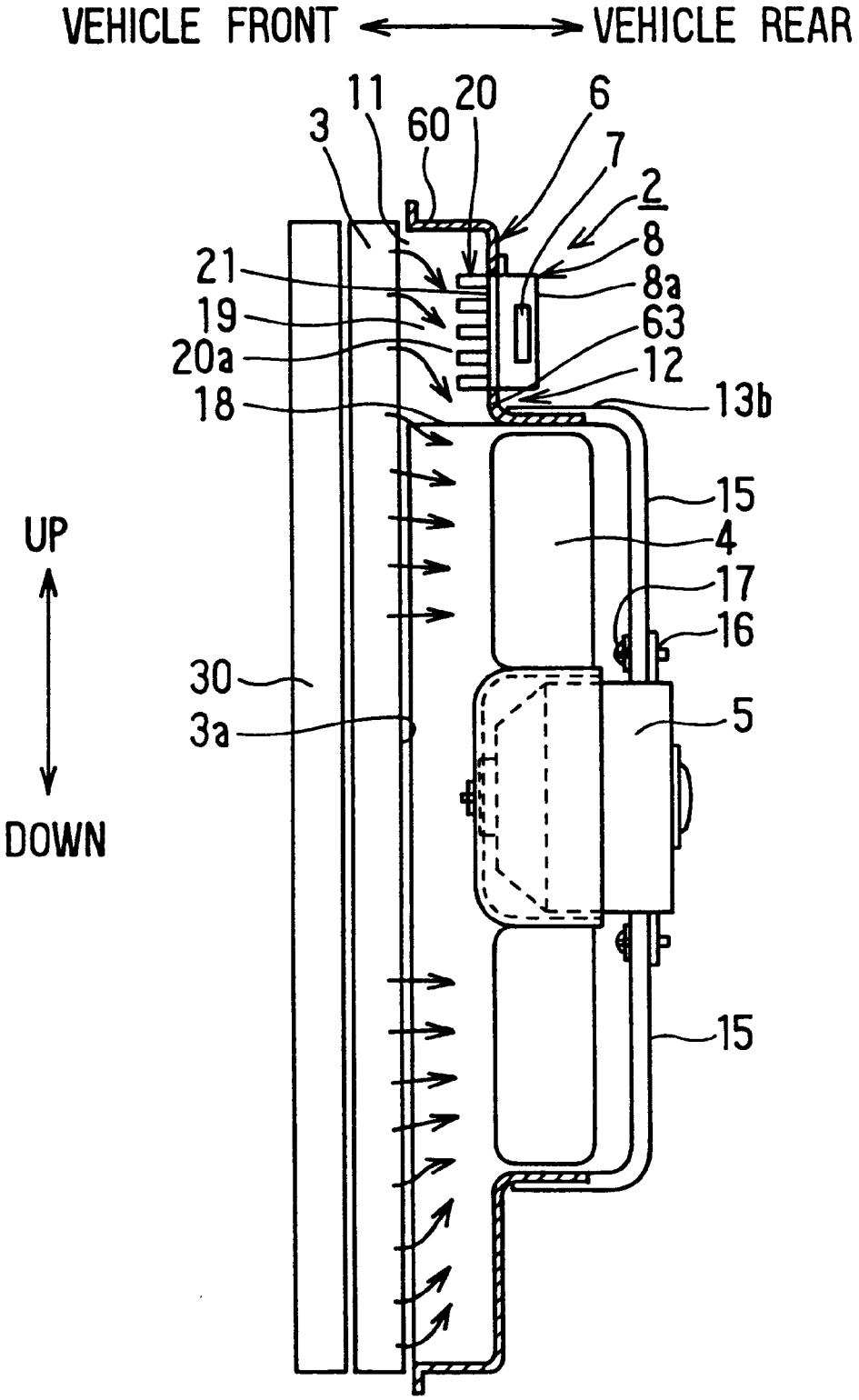
FIG. 7. is a schematic cross-sectional view showing a heat exchanging system according to a modification of the embodiment.
Figure 8:
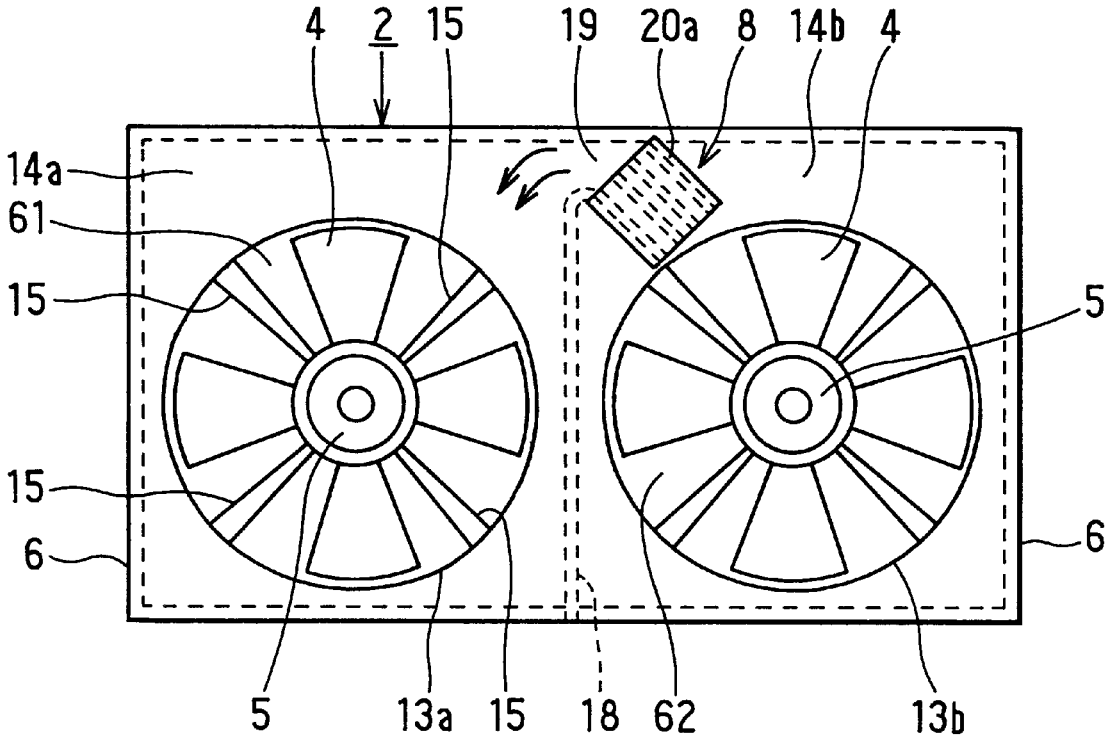
FIG. 8 is a front view of a heat exchanging system according to an another modification of the embodiment.

In the above-described embodiment, the fan shroud 6 has the air intake port 22; however, the air intake port 22 may be not formed in the fan shroud 6 as shown in FIG. 7. Further, in the above-described embodiment, the control device 8 is attached to the attachment portion 63; however, the control device 8 may be attached to anywhere on the outer surface of the fan shroud 6. In the above-described embodiment, the control device 8 is disposed at the upper center position between the air passages 14*a* an 14*b* so that cool air generated by the two cooling fans 4 is blown toward the control device 8. However, the control device 8 may be disposed in the air passage 14*b* as shown in FIG. 8.

Further, in the above-described embodiment, when either one of the cooling fans 4 has an abnormity and stops operation, the electric motor 5 of the other cooling fan 4 is set at the maximum rotational speed. However, the other cooling fan 4 may be set at a predetermined high rotational speed. In the above-described embodiment, the heat exchanging system 2 employs suction-type cooling fans, and the radiator 3, the fan shroud 6 and the cooling fans 4 are disposed in this order from the vehicle front side to the vehicle rear side. However, the heat exchanging system 2 may employ forcing-type cooling fans, and the cooling fans 4, the fan shroud 6 and the radiator 3 are disposed in this order from the vehicle front side to the vehicle rear side.

In the above-described embodiment, the heat exchanging system 2 has two cooling fans 4 and two electric motors 5;

however, the heat exchanging system 2 may have one cooling fan 4 and one electric motor 5. Further, in the above-described embodiment, the attachment portion 63 extends to be parallel to the ventilation surface 3*a* of the radiator 3; however, the attachment portion 63 may be slightly inclined.

Further, in the above-described embodiment, the heat exchanging system 2 is applied to the radiator 3 for cooling the engine cooling water and the condenser 30 for cooling refrigerant of the refrigerant cycle. However, the heat exchanging system 2 may be applied to an oil cooler for cooling vehicle operation oil (e.g., engine oil), an intercooler for lowering an intake-air temperature of the engine 1, and the like.

Such changes and modifications are to be understood as being within the scope of the present invention as defined in the appended claims.

What is claimed is:

1. A heat exchanging system for a vehicle having an engine compartment and an engine disposed in the engine compartment, said heat exchanging system comprising:

a heat exchanger for performing heat exchange between heat exchanging medium flowing within said heat exchanger and air passing through said heat exchanger;

a cooling fan for blowing air toward said heat exchanger to cool the heat exchanging medium within said heat exchanger;

an electric motor for driving said cooling fan;

an air guiding duct, disposed between said heat exchanger and said cooling fan, for guiding air generated by said cooling fan to pass through said heat exchanger;

a control device having a semiconductor switching element for controlling a rotational speed of said electric motor, and a radiation fin unit for facilitating heat radiation of said semiconductor switching element, wherein:

said control device is attached to an outer surface of said air guiding duct in such a manner that said radiation fin unit is disposed inside said air guiding duct.

2. The heat exchanging system according to claim 1, wherein:

said air guiding duct has an opening portion for communicating an outside of said air guiding duct with an inside thereof; and said radiation fin unit is disposed inside said air guiding duct through said opening portion.

3. The heat exchanging system according to claim 1, wherein said air guiding duct has an air intake port at an upstream air side proximate to said radiation fin unit.

4. The heat exchanging system according to claim 1, wherein said radiation fin unit has a plurality of plate-like radiation fins laminated at an interval in parallel with a flow direction of air flowing through said air guiding duct.

5. The heat exchanging system according to claim 1, wherein:

said cooling fan has a first fan portion and a second fan portion; and said electric motor has a first motor portion for driving said first fan portion and a second motor portion for driving said second fan portion.

6. The heat exchanging system according to claim 5, wherein:

said air guiding duct includes a duct portion, having a shape similar to an outer shape of said heat exchanger, at an immediately downstream air side of said heat exchanger, a first fan accommodating portion, formed in a cylindrical shape at a downstream air side of said duct portion, for accommodating said first fan portion, and a second fan accommodating portion, formed in a cylindrical shape at a downstream air side of said duct portion in parallel with said first fan accommodating portion, for accommodating said second fan portion; and said first and second fan accommodating portions have an air-flow sectional area smaller than that of said duct portion.

7. The heat exchanging system according to claim 6, wherein:

said air guiding duct has an attachment portion disposed on an extending line for connection said duct portion and said first and second fan accommodating portions; and said control device is attached to said attachment portion.

8. The heat exchanging system according to claim 7, wherein:

said heat exchanger has a ventilation surface perpendicular to a flow direction of air passing through said heat exchanger; and said attachment portion is disposed to extend substantially parallel to said ventilation surface of said heat exchanger.

9. The heat exchanging system according to claim 5, wherein:

said radiation fin unit is disposed at a center portion between said first and second fan portions in such a manner air generated by said first and second fan portions is blown toward said radiation fin unit.

10. The heat exchanging system according to claim 9, wherein:

said air guiding duct has a partition portion, at a center portion between said first and second fan portions, for partitioning an interior of said air guiding duct into a first air passage corresponding to said first fan accommodating portion and a second air passage corresponding to said second fan accommodating portion; and said partition portion is formed to have a communication path for communicating said first air passage and said second air passage.

11. The heat exchanging system according to claim 10, wherein said radiation fin unit is disposed in said communication path.

12. The heat exchanging system according to claim 10, wherein said control device is disposed at a side of said first air passage in such a manner that said radiation fin unit is disposed in said first air passage to be shifted from said communication path.

13. The heat exchanging system according to claim 10, wherein said partition portion is disposed to guide air toward said radiation fin unit when any one of first and second fans is stopped.

14. The heat exchanging system according to claim 5, further comprising:

a physical amount detecting unit for detecting a physical amount of the heat exchanging medium of said heat exchanger;

an abnormity determining unit for determining an abnormity of said first and second motor portions, wherein:

said control device controls each rotational speed of said first and second motor portions according to the physical amount detected by said physical amount detecting unit; and said first motor portion is set to have a rotational speed more than a predetermined speed when said abnormity determining unit determines that said second motor portion has the abnormity.

15. The heat exchanging system according to claim 1, wherein:

said heat exchanger is disposed in said engine compartment at a vehicle front side of said engine; and said cooling fan is disposed between said heat exchanger and said engine.

16. The heat exchanging system according to claim 1, wherein said heat exchanging medium is cooling water for cooling said engine.

17. A cooling fan system for a heat exchanger for performing heat exchange between air passing through said heat exchanger and heat exchanging medium flowing in said heat exchanger, said cooling fan system comprising:

a cooling fan for blowing air toward said heat exchanger to cool the heat exchanging medium within said heat exchanger;

an electric motor for driving said cooling fan;

an air guiding duct, disposed between said heat exchanger and said cooling fan to extend from an immediately downstream air side of said heat exchanger toward said cooling fan, for guiding air generated by said cooling fan to pass through said heat exchanger;

a control device for controlling a rotational speed of said electric motor; and a radiation fin unit, connected to said control device, for facilitating heat radiation of said control device, wherein:

said control device is attached to an outer surface of said air guiding duct in such a manner that said radiation fin unit is disposed inside said air guiding duct.

18. The cooling fan system according to claim 17, wherein:

said air guiding duct has an opening portion for communicating an outside of said air guiding duct with an inside thereof; and said radiation fin unit is disposed inside said air guiding duct through said opening portion.

19. The heat exchanging system according to claim 18, wherein:

said cooling fan has a first fan portion and a second fan portion;

said electric motor has a first motor portion for driving said first fan portion and a second motor portion for driving said second fan portion;

said air guiding duct includes a duct portion, having a shape similar to an outer shape of said heat exchanger, at an immediately downstream air side of said heat exchanger, a first fan accommodating portion, formed in a cylindrical shape at a downstream air side of said duct portion, for accommodating said first fan portion, and a second fan accommodating portion, formed in a cylindrical shape at a downstream air side of said duct portion in parallel with said first fan accommodating portion, for accommodating said second fan portion; and said first and second fan accommodating portions have an air-flow sectional area smaller than that of said duct portion.

20. The heat exchanging system according to claim 19, wherein:

said air guiding duct has an attachment portion disposed on an extending line for connection said duct portion and said first and second fan accommodating portions;

said attachment portion is disposed to extend substantially perpendicular to a flow direction of air passing through said heat exchanger; and said control device is attached to said attachment portion in such a manner that said radiation fin unit is disposed inside said air guiding duct.

* * * * *